United States Patent [19]

Winter et al.

[11] 4,167,100

[45] Sep. 11, 1979

[54] METHOD FOR REMOVING WATER-SOLUBLE INORGANIC SALTS AND ICE FROM HEAT EXCHANGE SURFACES

[75] Inventors: Richard G. Winter, Ponca City, Okla.; John H. A. Ramage, Fife, Scotland

[73] Assignee: Conoco Methanation Company, Stamford, Conn.

[21] Appl. No.: 847,981

[22] Filed: Nov. 2, 1977

[30] Foreign Application Priority Data

Apr. 4, 1977 [GB] United Kingdom ..... 14148/77

[51] Int. Cl.[2] ..... F25D 21/12; F25D 21/10

[52] U.S. Cl. ..... 62/82; 62/282

[58] Field of Search ..... 62/17, 82, 282, 85

[56] References Cited

U.S. PATENT DOCUMENTS

| | | | |
|---|---|---|---|
| 2,686,407 | 8/1954 | Zellner | 62/82 |
| 2,863,527 | 12/1958 | Herbert et al. | 62/17 |

*Primary Examiner*—Lloyd L. King

*Attorney, Agent, or Firm*—F. Lindsey Scott; William A. Mikesell, Jr.

[57] ABSTRACT

A method for removing water-soluble inorganic salts and ice from refrigerated heat exchange surfaces by contacting the surfaces with a methanol-water mixture.

3 Claims, 1 Drawing Figure

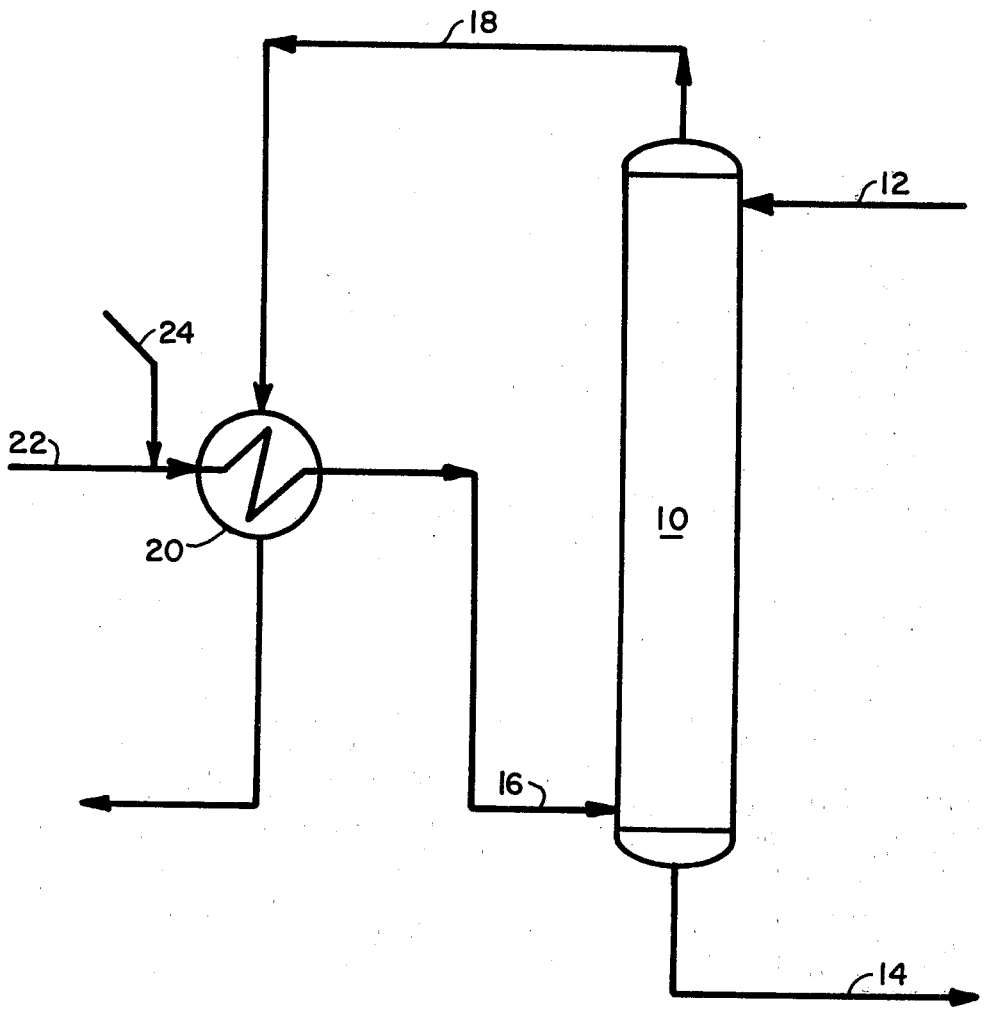
18
12
24
22
20
10
16
14

METHOD FOR REMOVING WATER-SOLUBLE INORGANIC SALTS AND ICE FROM HEAT EXCHANGE SURFACES

This invention relates to a method for removing water-soluble salts from refrigerated heat exchange surfaces.

This invention further relates to a method for removing water-soluble inorganic salts, organic materials and ice from refrigerated heat exchange surfaces.

In numerous industrial applications, heat exchange surfaces are used to cool streams which contain trace amounts of water-soluble inorganic salts, organic materials and water. In such instances, the water, organic materials and inorganic salts tend to be precipitated onto the heat exchange surfaces when cooling is continued to temperatures below about 32° F.

Heretofore, methanol has been used to remove ice and organic materials from such surfaces as disclosed in U.S. Pat. No. 2,863,527 issued Dec. 9, 1958 to Herbert et al; however, the use of methanol in such instances does not remove water-soluble inorganic salts which in many instances are co-deposited with the ice. As a result, it has been necessary to clean the heat exchange surfaces frequently.

It has now been found that such surfaces can be maintained in a clean servicable condition for substantially greater periods of time between cleaning by the use of a method for removing water-soluble inorganic salts, organic materials and ice from such refrigerated heat exchange surfaces wherein the method comprises contacting the surfaces with a methanol-water mixture containing at least about 20 weight percent methanol.

The FIGURE is a flow diagram of heat exchange arrangement utilizing the method of the present invention.

The method of the present invention is useful with refrigerated heat exchange surfaces which operate at temperatures below 32° F. (0° C.). Such surfaces, when used to cool streams which contain water, minor amounts of water-soluble inorganic salts or compounds which react to form water-soluble inorganic salts and the like, are subject to fouling as ice and the salts are formed on the heat exchange surfaces. One specific example of such an application comprises the use of methanol contacting to remove hydrogen sulfide, organic sulfur compounds such as COS, $CS_2$, thiophene and mercaptans, carbon dioxide, water, $NH_3$, hydrocarbons and other catalyst contaminants or poisons from synthesis gas streams used in the production of methane by the reaction of carbon oxides and hydrogen. The streams passed to the methanol contacting typically contain $H_2S$, CO, $CO_2$, $H_2O$, COS, $CS_2$, $C_4H_4S$, $CH_4$, $NH_3$, $H_2$, and in some instances, heavier hydrocarbon compounds. In the methanol contacting, the $H_2S$, COS, $CS_2$, $C_4H_4S$, $CO_2$, $H_2O$, and heavier hydrocarbon compounds are removed to a substantial extent. In most such applications, an effort is made to remove substantially all of these compounds from the synthesis gas stream which comprises primarily CO, $CO_2$, $H_2$, and $CH_4$. Obviously, the methanol contacting is at a low temperature and is typically conducted at temperatures of −40° F. (−40° C.) and below. To conserve energy, the cold synthesis gas mixture produced as a result of the methanol contacting is passed to a heat exchanger where it is used as a heat exchange fluid to cool the incoming impure synthesis gas stream to temperatures below 32° F. (0° C.) and in some instances as low as −30° F. (−35° C.). The impure synthesis gas so cooled as indicated above contains water and minor amounts of ammonia and carbon dioxide which react according to the following equation.

$$CO_2+H_2O+NH_3 \rightleftarrows NH_4HCO_3$$

to form ammonium bicarbonate which is a water-soluble salt which deposits on the heat exchange surfaces. Of course, ice also deposits upon the heat exchange surfaces. Heretofore, methanol has been used to remove the ice from the heat exchange surfaces. It has been observed, however, that the use of methanol does not clean the heat exchange surfaces completely and it is necessary that the heat exchange surfaces be cleaned frequently by other means in order to maintain heat exchange efficiency.

It has now been found that the heat exchange surfaces in contact with such impure synthesis gas, can be maintained in operation for extended periods of time by the use of a methanol-water mixture for flushing the heat exchange surfaces. The methanol-water mixture should contain at least 20 weight percent methanol and desirably, at least 40 weight percent methanol.

The use of mixtures containing insufficient water are less effective in removing water-soluble salts and the use of insufficient quantities of methanol results in a mixture which is less effective in removing organic materials and which tends to freeze on the heat exchange surfaces. Thus it is preferred that the mixture contain from 20 to 70 weight percent methanol and especially desirable results have been obtained wherein the mixture contained from 40 to 60 weight percent methanol with the preferred composition being about 50 weight percent methanol. Such mixtures have been found effective in removing the inorganic salt deposits, i.e. ammonium bicarbonate, ice and any heavier hydrocarbon materials which may have deposited on the heat exchange surfaces. The use of such methanol-water mixtures has been found to be surprisingly effective in dissolving the limitedly water-soluble ammonium bicarbonate (11.9 grams per 100 ml. of water of 0° C.), the heavier hydrocarbons and ice. The synergistic improvement achieved by the use of the methanol-water mixtures has resulted in an extended heat exchange surface life, and improved efficiency during operations.

The FIGURE is a schematic flowsheet of a methanol contact column and a heat exchanger wherein the method of the present invention is used. A column 10, having a methanol inlet 12 and a methanol outlet 14 is shown. Impure synthesis gas is charged to the lower portion of column 10 through an impure synthesis gas inlet 16 and the purified synthesis gas is recovered through a purified synthesis gas line 18. The impure synthesis gas is charged to column 10 after passage through a heat exchanger 20 via an inlet line 22. The heat exchanger is cooled by the flow of purified synthesis gas from line 18. The heat exchange surfaces are cleaned periodically by flushing with a methanol-water mixture through line 24. The methanol-water mixture is passed over the heat exchange surfaces in contact with the impure synthesis gas stream and forms a portion of the impure synthesis gas stream passing to column 10 through line 16. The methanol and water are both removed in the methanol column so that neither appears in the purified synthesis gas stream flowing through line 18. It is not necessary to contact the heat exchange surfaces in contact with the purified synthesis gas since substantially no water or carbon dioxide is contained therein. Clearly the methanol-water flushing can be either periodic or continuous as required by the deposition rate of ice, ammonium bicarbonate, other fouling materials, and the like.

While the present invention has been discussed with reference to certain specific embodiments, it should be clearly understood that the embodiments discussed, while preferred, are illustrative rather than limiting in nature and that many variations and modifications are possible within the scope of the present invention. It is anticipated that those skilled in the art may consider many such variations and modifications obvious or desirable in view of the foregoing description of preferred embodiments.

Having thus described the invention, we claim:

1. In a method for removing hydrogen sulfide, organic sulfur compounds, carbon dioxide, water, ammonia and hydrocarbons from a synthesis gas stream comprising primarily carbon monoxide, carbon dioxide, hydrogen and methane by cooling said synthesis gas stream to a temperature below 32° F. in a heat exchange zone and thereafter contacting said synthesis gas stream with methanol at a temperature below about −40° F. in a methanol contacting zone to remove said hydrogen sulfide, organic sulfur compounds, carbon dioxide, water, ammonia and hydrocarbons, the improvement comprising flushing the heat exchange surfaces in said heat exchange zone with a methanol-water mixture containing from 20 to 70 weight percent methanol to remove ice and water-soluble inorganic salts from said heat exchange surfaces.

2. The improvement of claim 1 wherein said methanol-water mixture contains from 40 to 60 weight percent methanol.

3. The improvement of claim 1 wherein said heat exchange surfaces are intermittently flushed with said methanol-water mixture to remove said ice and said water-soluble inorganic salts.

* * * * *